US005625159A

United States Patent [19]

Malolepsy et al.

[11] Patent Number: 5,625,159

[45] Date of Patent: Apr. 29, 1997

[54] TANK TURRET ROTATION SYSTEM AND METHOD

[75] Inventors: Hans-Peter Malolepsy, Vellmar; Hilmar Rabe, Wanfried-Aue, both of Germany

[73] Assignee: Firma Wegmann & Co., GmbH, Germany

[21] Appl. No.: 884,533

[22] Filed: Apr. 8, 1992

Related U.S. Application Data

[63] Continuation of Ser. No. 517,649, Apr. 18, 1990, abandoned.

[30] Foreign Application Priority Data

Apr. 27, 1989 [DE] Germany ..... 39 13 902.6

[51] Int. Cl.[6] ..... F41H 7/02

[52] U.S. Cl. ..... 89/36.08; 89/36.13; 89/37.11

[58] Field of Search ..... 89/36.08, 36.13, 89/37.11, 40.03

[56] References Cited

U.S. PATENT DOCUMENTS

| | | | |
|---|---|---|---|
| 3,244,076 | 4/1966 | Wey | 89/37.11 |
| 3,430,534 | 3/1969 | Agren | 89/37.11 |
| 3,837,260 | 9/1974 | Agren et al. | 89/37.11 |
| 4,444,089 | 4/1984 | Pietzsch et al. | 89/36.13 |

FOREIGN PATENT DOCUMENTS

| | | | |
|---|---|---|---|
| 1095165 | 12/1960 | Germany | 89/37.11 |
| 2330196 | 1/1975 | Germany | 89/36.13 |

*Primary Examiner*—Stephen C. Bentley
*Attorney, Agent, or Firm*—Rogers & Killeen

[57] ABSTRACT

A combat vehicle, in particular a combat tank, with a weapon mounted outside its longitudinal middle axis, that is mounted on a vertical axis rotatable ring mount linked by rotational rings to the hull of the vehicle. Within the rotational rings is a controllable coupling with plural coupling elements distributed on the circumference of the rotational ring. The coupling elements are, in a disengaged position, freely rotable in the ring mount and in an engaged position are unrotatable in the ring mount linked to the hull. During firing of the weapon, the coupling elements are controlled such that after the exit of the projectile from the weapon barrel but before the ending of the free weapon barrel recoil, the couplings are moved to an engaged position.

9 Claims, 3 Drawing Sheets

TANK TURRET ROTATION SYSTEM AND METHOD

This is a continuation of application Ser. No. 517,649, filed on Apr. 18, 1990, now abandoned.

The present invention is directed generally to a combat vehicle, and in particular, to a combat tank with a weapon mounted outside its axis of rotation, the weapon being supported on its vertical axis with a swivel ring mount which is linked by a rotational ring to the vehicle hull.

In the development of the combat tank it has increasingly been proven advantageous, given the conventional components of a combat tank turret and the crew lodging compartment, for them to be closely linked to the hull, spatially central and raised. Accordingly, a weapon for a combat tank may be mounted outside the central area housing the crew compartment and may be equipped with a swivel ring mount. As a result of this spatial arrangement, the barrel of the weapon covers as least half the crew compartment in its horizontal traverse on the axis of rotation.

When a weapon is mounted on a ring mount, particularly a heavy weapon, it produces a recoil force when it is fired, resulting in an extraordinary high shock moment on the ring mount. This shock moment tends to accelerate the horizontal rotation of the weapon about the ring mount. To retain the ring mount and the weapon in the direction of the target, it is generally necessary to set up a corresponding resistance to this impulse type moment.

The present invention in one aspect provides a combat vehicle in which the weapon will return to the target direction even when the firing-produced recoil force is exceedingly high.

In one aspect of the present invention, the vehicle uses a controlled coupling on much of the circumference of the rotational ring to distribute the recoil force. In this aspect of the invention, the coupling elements may be disengaged in which position they are free to rotate in the ring mount or they may be engaged in which position they are non-rotatable in the ring mount which is likewise coupled to the hull. In this aspect of the invention, the coupling is controlled so that upon firing the weapon, the coupling returns to the engaged position after the exit of the shell from the weapon barrel but before the termination of the weapon barrel recoil.

The present invention arises from the knowledge that the inertia of the weapon and ring mount cannot resist the shock moment of the transverse movement of the weapon. The basic cncept of the invention provides that the load is carried over the mass of the entire vehicle in real time and with a speedy effective coupling. The resistance of the entire combat tank and resistance in its surface are appropriately used to compensate for the recoil energy of asymmetrically mounted weapons so that only a inconsequential, barely perceptible change in the directional position of the vehicle is noted upon firing of the weapon.

In one aspect, the operaton of the present invention can be understood from the following facts concerning a combat vehicle during firing:

After the ignition of a shot, the projectile passes through the weapon barrel and is directed in height and azimuth by the target-directed weapon barrel. Simultaneously, as a result of the conservation of momentum, the weapon barrel experiences a movement thrust in the opposite direction from the passing shot. Generally, while the projectile is passing through the barrel, the opposing force has no resistance through the mount. This period of tme is referred to as the "free weapon barrel recoil". Both the vehicle-coupled stabilization system and the free weapon barrel recoil assure that the target-directed shot remains directed toward the target despite the movement of the combat tank. It follows that the ring mount of a weapon on a combat tank must similarly permit the exit of a projectile being fired from the tank and the completion of the free weapon barrel recoil. If the linkage between the ring mounting and the vehicle is restrained too early will lead to a distortion of the shot exit. On the other hand, a delayed restraint, such as after the braking process of the barrel has begun, may result in damage to the ring mount. Both circumstances are undesireable.

In one aspect, the present invention solves these problems in the prior art by the advantageous use of a controllable coupling element which is capable of real-time rapid switching from engagement to non-engagement. In the present invention as used on combat vehicles, coupling elements are provided that have almost the same effectiveness as a direct termination of movement between the ring mount and the bearing position of the vehicle. The present invention can also be arranged in a space-saving manner so that the coupling effectiveness is realized in any position of the ring mount while obtaining wear-free and maintenance-free function.

These any other aspects and advantages of the present invention may be discerned from the following detailed description when read along with the accompanying drawing figures.

DETAILED DESCRIPTION OF THE PREFERRED EMBODIMENTS

Figure 1:
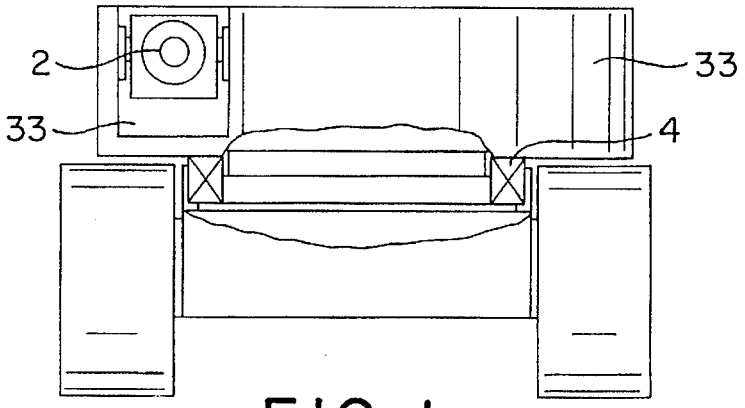
FIG. 1 is a pictorial representation of a frontal view of a combat tank having a heavy weapon arranged along a longitudinal middle axis thereof.
Figure 2:
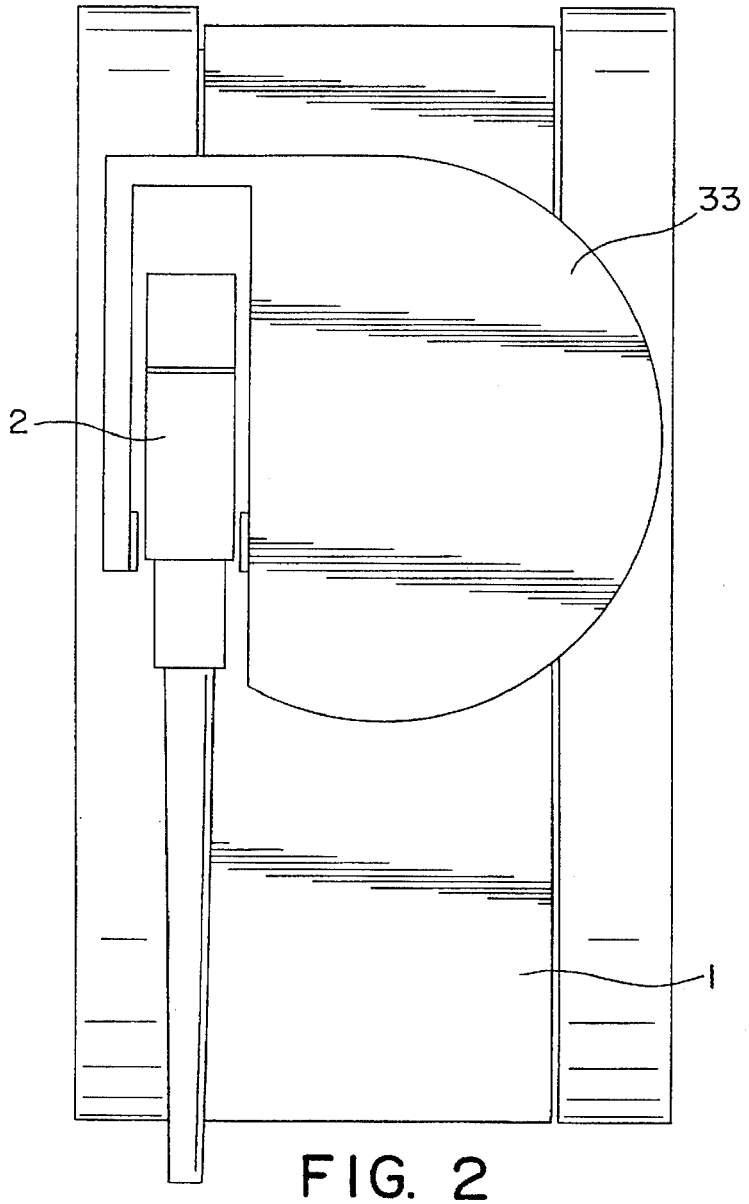
FIG. 2 is a pictorial representaion of an overhead view of the combat tanl of FIG. 1.

FIGS. 1 and 2 present a highly schematicized view of a combat tank possessing a rotating combat tank turret, equipped with a heavy weapon 2 along an external longitudinal middle axis, an elevated crew compartment with a ring mount 33 linked by a rotating ring 4 to the vehicle hull.

Figure 3:
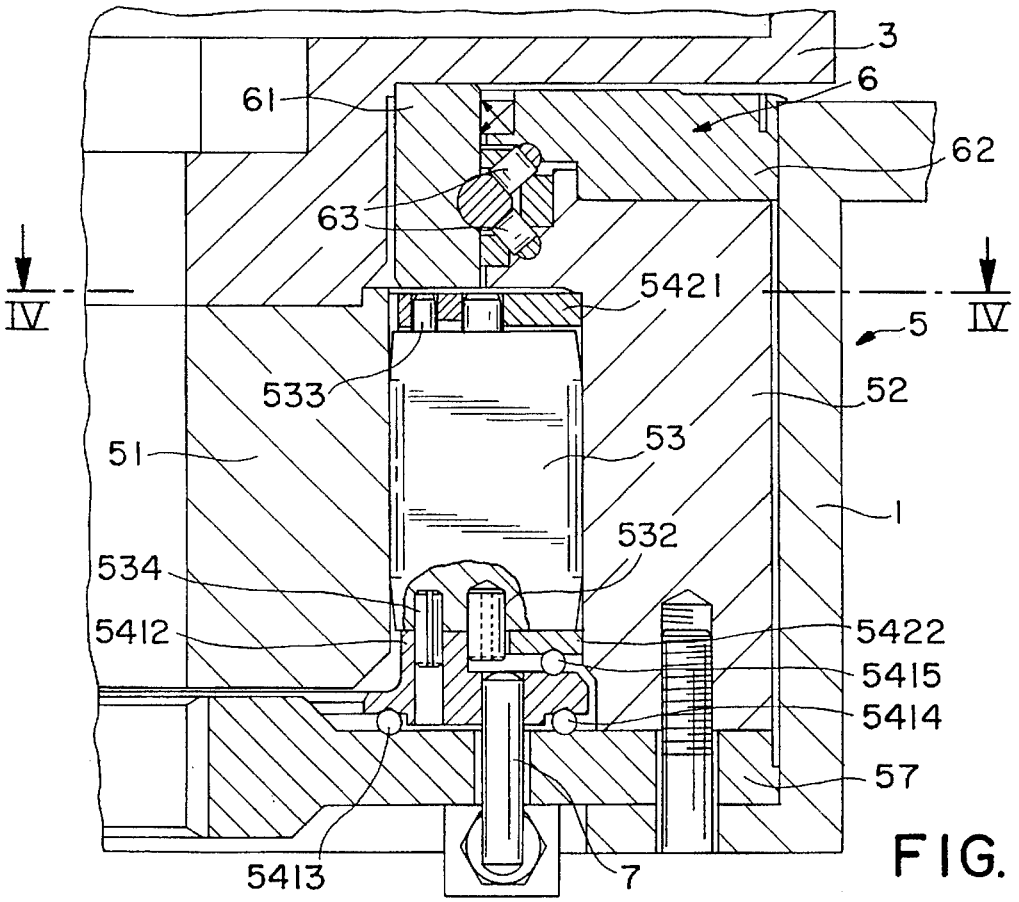
FIG. 3 is a a sectional representation of a portion of the tank of FIG. 1 illustrating the rotating ring of the present invention between a ring mount and the vehicle hull.
Figure 4:
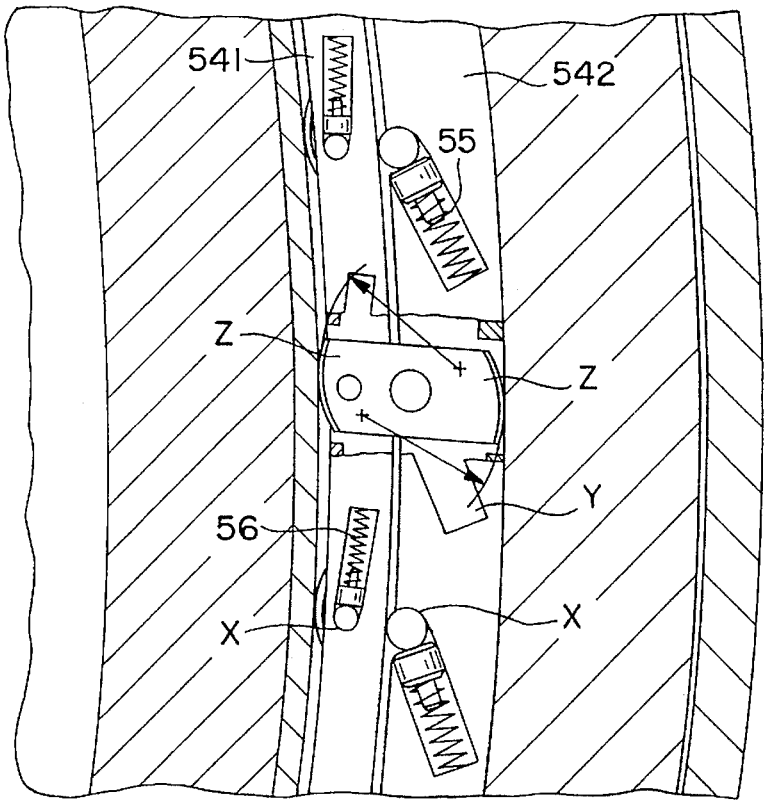
FIG. 4 is a horizontal sectional view through the rotating ring of FIG. 3 taken along lines IV–IV.

The construction of the rotating ring is shown further in FIGS. 3 and 4. With reference to FIGS. 3 and 4, a rotating ring of the present invention may include a bearing ring 6 and, directly under the bearing ring, a coupling ring 5. The bearing ring 6 may include a bearing inner ring 61 affixed to the vehicle 1, a coaxial bearing outer ring 62, and a cylinder 63, each of conventional components.

The coupling ring 5 may include an inner support ring 51 which is closely tied to the bearing inner ring 61, as well as an outer support ring 52 which is closely tied to the bearing outer ring 62. Between the inner surface of the outer support ring 52 and the outer surface of the outer bearing ring 51, there is a ring slot of a given width in which, along the entire ring circumference, plural coupling elements may be arranged. Each of the plural coupling elements may include revolving clamp bodies 53 on the vertical level of the coupling ring 5. The maximum cross sectional length of the clamp bodies 53 is larger than the width of the ring slot. The longitudinal end surfaces of the clamp bodies 53 are curved.

In a release (or non-engaged) position, the end surfaces of the clamp bodies 53 do not contact the surfaces of the inner support ring 51 or the outer support ring 52. In the expansion (or engaged) position, the end surfaces of the clamp bodies 53 engage the surfaces of the inner and outer support rings 51, 52 to effect a clamping thereof. The geometric shape of the clamp bodies 53, particularly the end surfaces thereof so that in the expansion position (at least in the rotational direction) the clamp bodies 53 transmit a delay torque to one of the support rings. To attain the required clamp effect, the bend of the end surfaces runs in an arc (Z in FIG. 4) whose midpoint eccentrically on the pivoting axis of the clamp bodies 53 lies in such a way that by rotation of the clamp bodies 53 in the expansion position, there is an ever increasing curving of the end surfaces to the support rings. In this way, the roattion of the clamp bodies 53 in the expansion position causes a kind of "elbow-lever effect "which prevents a distortion of the inner support ring 51 against the outer support ring 52.

With continued reference to FIGS. 3 and 4, for control and mounting of the clamp bodies 53, there is a ring slot between the support rings 52, 53, a spacer ring consisting of two partial rings, namely an inner spacer ring 541 and an outer spacer ring 542. On the upper flange of the clamp bodies 53 there is a pivot pin 532 engaged to the under flange 5421 of the outer spacer ring 542. Additionally, on the upper side of the clamp bodies 53 there is an upper attachment 533 that engages the inner spacer ring 541 on the upper flange while a lower attachment 534 on the underside of the clamp bodies 53 engages the under flange 5412 of the inner spacer ring 541. The two attachments 533, 534 are ecentrically on the rotation axis of the clamp bodies 53. When the clamp bodies are in engagement, there is a correspondingly effective torsion of the inner spacer ring 541 vis-a-vis the outer spacer ring 542 which serves to power lock the support rings 51, 52. The previously-described increased curving of the end surfaces of the clamp bodies 53 and the previously introduced rotation of the clamp bodies 53 toward the support rings produce the elbos-lever effect which leads to the desired functioning of the coupling ring 5. To ensure free flow of the coupling, the clamp bodies must be turned until their end surfaces are contact-free of the support rings 51, 52. Similarly, there should be a rapid and real-time prodction of the retarding effect by only the slightest torsion of the inner spacer ring 541 vis-a-vis the outer spacer ring 542 in the load direction. The mechanism to provide the required torsion to operate the clamp bodies can be any conventional means, including rapid operating electrical solenoids or hydralic cylinders.

With continued reference to FIGS. 3 and 4, the pivotal bearing of the inner spacer ring includes three cylinders 5413, 5414, 5415.

To compensate for manufacturing tolerances or inaccuracies of operation as a result of elastic distortion, the device of the present invention may include bearing pins 531, 532 and the attachments 533,534 in the spacer rings held by pressure rings 55, 56. In addition, the device may contain slots in the upper flange 5411, 5421 and the under flange 5412, 5422 of the spacer rings 541, 542 at both small and sharp angles to the circumferential direction. The slots may extend to the oblong bearing aperature X, Y in which the attachments 533, 534 and the bearing pins 531, 532 are incorporated and individually pressured through pressure springs 55, 56 against the slot ends. The pressure springs are moved by rapid switch movements. When enabled, the retarding effect of the pressure springs 55, 56 is transmitted over the attachments 533, 534 and bearing pins 531, 532 to position the clamp bodies 53 with respect to the spacer rings 541, 542.

By a proper fit selection for the movement area, the coupling mechanism when not in use does not interfere with the operation of the turret.

During the loading of the coupling ring there is a rolling process between the clamp bodies 53 and both support rings 51, 52 so that there can be compensation for the bearing of the clamp bodies 53 through the turning of the spacer rings 541, 542.

In loosening the coupling between the ring mount and the chassis, there may be encountered the additional resilience from the elastic distortion of the coupling ring. If necessary, the resilience may be overcome by a suitable, convention transverse drive which provides a short-term start to the loosening. Note that with the part design of the present invention automatic locking between the clamp bodies 53 and the support rings 51, 52 is made extremely difficult if not impossible.

Figure 5:
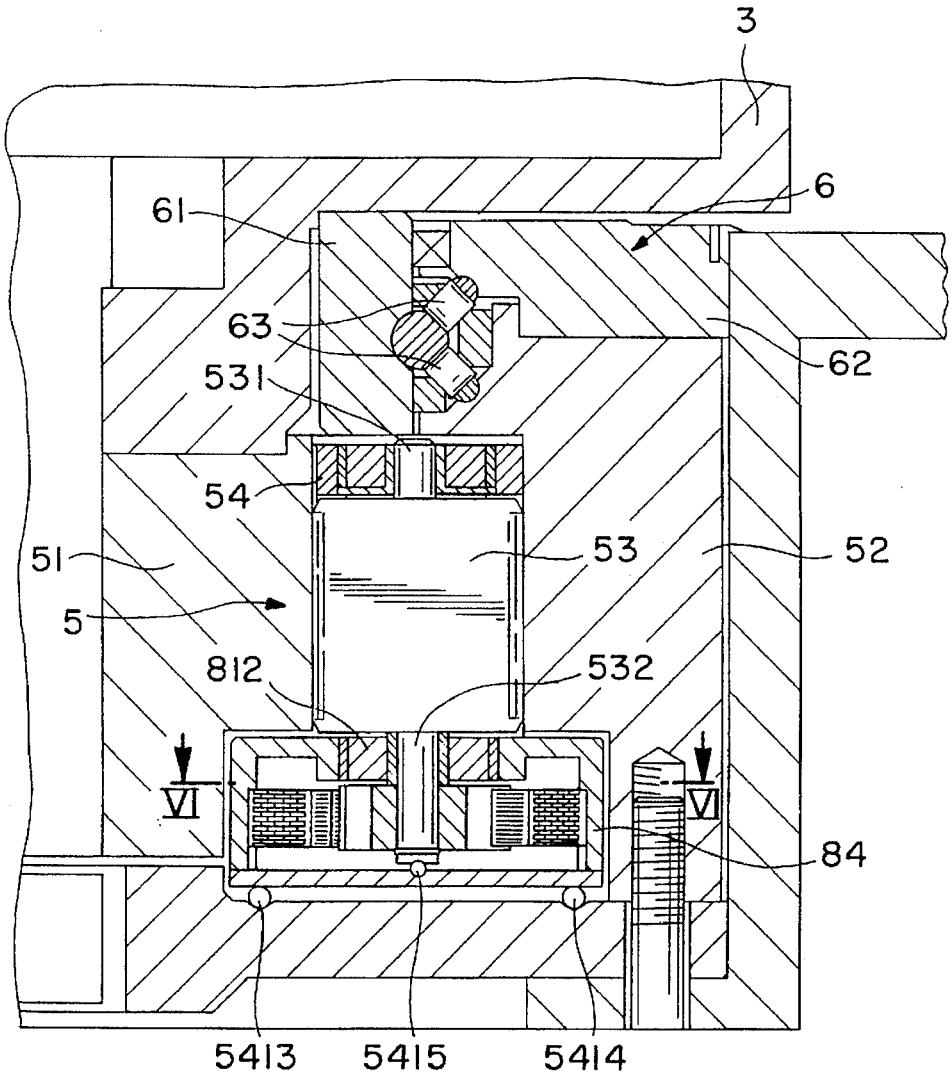
FIG. 5 is a sectional representation of a portion of the tank of FIG. 1 illustrating the rotating ring in another embodiment of the present invention.
Figure 6:
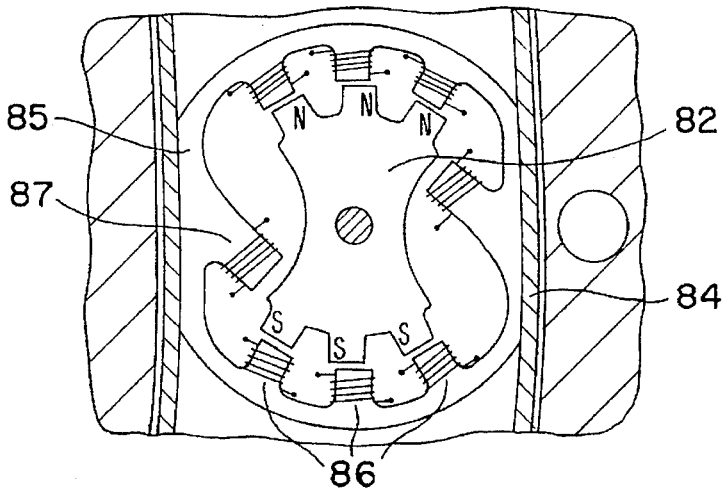
FIG. 6 is a horizntal sectional view through the rotating ring of FIG. 5.

With reference now to FIGS. 5 and 6, where like reference numerals are used to denote like components to those identified with respect to FIGS. 3 and 4, another embodiment of the present invention may include a rotational ring with a coupling ring which is equally effectively engaged by the clamp bodies as in the first embodiment but each of the clamp bodies 53 has its own electromagnetic operation.

With continued reference to FIGS. 5 and 6, a coupling ring 5 may be located immediately below a bearing ring 6. The bearing ring has a bearing inner ring 61 which is connected to a ring mount 3 while the bearing outer ring 62 is connected to the hull of the vehicle 1. A cylinder 63 is also arranged as shown within the bearing.

The coupling ring 5 includes an inner support ring 51 and an outer support ring 52. In the ring space between both support rings 51, 52 plural clamp bodies 53 are distributed over the circumference. In the ring space between the support rings 51, 52 there is also a spacer ring 54. In the area below the clamp bodies 53, there is a clamp body drive 84.

The clamp bodies 53 are eleastically supported in the spacer ring 54. Specifically, a bearing upper pin 531 of the clamp bodies 53 sits atop an elastic bearing 811 that is, in turn, connected to the upper flange of the spacer ring 54. In addition, a bearing lower pin 532 is connected to the under flange of the spacer ring 54 and sits atop an elastic bering 812 of the under flange of the spacer ring 54.

The lower bearing pin 532 extends and bears at its end a permanent magnet, a pivoted armature 82 which is in the clamp body drive 84 of the spacer ring 54. The pivoted armature 82 is within a stator ring 85 made of laminated plates and is provided with a magnetic coil for the production of an electromagnetic effect. The magnetic coil lies around a 2×3 cogged structure 86 on the inner wall of the stator ring 85. The cogged structure of the stator ring 85 also lies adjacent a similar 2×3 cogged structure on the pivoted armature 82. In addition, a traverse movement area with a magnetic coil 87 is located along each side of the cogged structure 86.

The spacer ring 54 is supported by by cylinders 5413, 5414, 5415 against a base plate 57 of the coupling ring 5 as well as against the lower bearing pin 532.

The switching function for the coupling ring 5 is achieved by a selective change in direction of the current in the magnetic coil. The retarding effects of the clamp bodies 53 arise from the selective operation of the current in the magnetic coil to effect an attraction or a repelling force between the pole teeeth 83 of the cogged structure of the pivoted armature 82 and the cogged structure 86 of the stator ring 85. The rotational movement induced by the attraction and/or repelling force causes the clamp bodies 53 to lock or unlock between the inner and outer supporting rings 51, 52.

A release of the clamp bodies 53 comes through a reversal of the electrical current direction. Thus, the pivoted armature 82 comes to the magentic coil 87 of the traverse movement area and may be held in that position electromagnetically. When the pivoted armature 82 is in the traverse movement area, removes the clamp bodies from interfering with the coupling ring which is then free to rotate.

We claim:

1. A combat vehicle, having a weapon mounted on a ring mount for rotation about a vertical axis, said weapon being mounted off said axis, and said ring mount being connected to the hull of the vehicle by a rotation ring wherein:

said rotation ring comprises a controllable coupling comprising plural coupling elements distributed along the surface of the rotation ring;

said coupling elements having engaged positions and disengaged positions, whereby in the disengaged position the coupling elements are freely rotable in the ring mount;

said controllable coupling further comprising control means to control the position of said coupling elements whereby when a projectile is fired from the weapon the coupling elements are disengaged and after the exit of the projectile from the weapon, and before the end of recoil of the weapon, the coupling elements are moved to an engaged position.

2. A combat vehicle, in accordance with claim 1, wherein:

said rotational ring comprises a bearing ring and a coaxial coupling ring, said coupling ring being located directly under the bearing ring;

wherein said bearing ring comprises a bearing outer ring and a coaxially arranged bearing inner ring, one of which is directly connected to with the ring mount, and the other of which is directly connected with the vehicle hull;

wherein said coupling ring comprises two support rings coaxial to each other;

wherein between an inner surface of said bearing outer ring, an outer surface of said bearing inner ring, a ring slot of predetermined width is provided;

wherein within said ring slot are provided plural clamp bodies, the maximum cross sectional length of each is larger than the width of the ring slot and whose end surfaces of each are curved support surfaces; and, wherein when said clamps are in a disengaged position, said support surfaces are contact-free of the surfaces of both support rings and when said clamps are in an engaged position, said support surfaces contact the surfaces of both support rings to effect a clamping thereof.

3. A combat vehicle, in accordance with claim 2, wherein the curving of the support surfaces goes in an arc whose midpoint is eccentric to the axis of rotation of the clamp bodies.

4. A combat vehicle, in accordance with claim 2, further comprising engagement means to cause the engagement and disengagement of said clamp bodies; and, wherein said clamp bodies are held in the ring slot between an inner spacer ring and an outer spacer ring that are relatively rotatable to each other, whereby said clamp bodies and said inner spacer ring and outer spacer ring are set in said support rings and the axis of rotation of the clamp bodies is fixed in one of said spacer rings.

5. A combat vehicle, in accordance with claim 4 wherein said engagement means comprises a switching device pressure cylinder.

6. A combat vehicle, in accordance with claim 4, wherein said engagement means comprises an electromagnetic actuator.

7. A combat vehicle, in accordance with claim 3, wherein said clamp bodies are supported on bearing pins and wherein said clamp bodies are urged into engagement by pressure springs.

8. A combat vehicle, in accordance with claim 1, wherein each of said clamp bodies is located in the ring slot between the support rings; and wherein each of said clamp bodies is moved into engagement by a permanent magnet pivoted armature.

9. A combat vehicle, in accordance with claim 8, wherein said armature is electromagnetically influenced by a stator ring, said stator ring having plural pole teeth.

* * * * *